US005772419A

United States Patent [19]

Hansen et al.

[11] Patent Number: 5,772,419

[45] Date of Patent: Jun. 30, 1998

[54] HYDRAULIC MACHINE COMPRISING A GEARWHEEL AND ANNUAL GEAR HAVING TROCHOID TOOTH SECTIONS

[75] Inventors: Gunnar Lyshøj Hansen; Hans Christian Petersen, both of Nordborg, Denmark

[73] Assignee: Danfoss A/S, Nordborg, Denmark

[21] Appl. No.: 535,008

[22] PCT Filed: Mar. 25, 1994

[86] PCT No.: PCT/DK94/00127

§ 371 Date: Dec. 5, 1995

§ 102(e) Date: Dec. 5, 1995

[87] PCT Pub. No.: WO94/23208

PCT Pub. Date: Oct. 13, 1994

[30] Foreign Application Priority Data

Apr. 5, 1993 [DE] Germany ..... 43 11 168.8

[51] Int. Cl.[6] ..... F01C 1/10

[52] U.S. Cl. ..... 418/61.3; 418/150; 418/171

[58] Field of Search ..... 418/61.3, 150, 418/166, 171

[56] References Cited

U.S. PATENT DOCUMENTS 3,424,095 1/1969 Hansen ..... 418/61.3

5,368,455 11/1994 Eisenmann ..... 418/150

FOREIGN PATENT DOCUMENTS 61-210283 9/1986 Japan ..... 418/166

61-223283 10/1986 Japan ..... 418/166

84586 3/1957 Netherlands ..... 418/171

*Primary Examiner*—John J. Vrablik

*Attorney, Agent, or Firm*—Lee, Mann, Smith, McWilliams, Sweeney & Ohlson

[57] ABSTRACT

A hydraulic machine with two displacement elements (2,3) rotatably movable relative to one another, namely, a gearwheel (2) and an annular gear (3) of which the number of teeth is one more than the number of teeth (N) of the gearwheel (2), in which machine the tooth form of a least one displacement element (2,3) is defined at least over sections by a trochoid-type curve T=f (RC, E, RT) as the function of a reference circle radius RC, an eccentricity E and a generating circle radius RT. In a machine of that kind, it is desirable for the efficiency and the running behaviour to be improved and for wear to be reduced. To that end, of the parameters (RC, E, RT) determining the function f, at least one parameter varies in the circumferential direction periodically with the period of a tooth pitch (Z).

13 Claims, 7 Drawing Sheets

HYDRAULIC MACHINE COMPRISING A GEARWHEEL AND ANNUAL GEAR HAVING TROCHOID TOOTH SECTIONS

The invention relates to a hydraulic machine with two displacement elements rotatably movable relative to one another, namely, a gearwheel and an annular gear of which the number of teeth is one more than the number of teeth of the gearwheel, in which machine the tooth form of at least one displacement element is defined at least over sections by a trochoid-type curve T=f (RC, E, RT) as the function of a reference circle radius RC, an eccentricity E and a generating circle radius RT.

A machine of that kind is known, for example, from U.S. Pat. No. 2,421,463. The (N+1) teeth of the toothed ring, which project inwards and are consequently also referred to in the following as internal teeth, consist either of free cylindrical rollers or of fixed cylinder segments. The N external teeth of the gearwheel are produced by a circle system, the circles of which lie with their midpoints on a cycloid. The cycloid is created in that a rolling circle rolls on a base circle without slipping, the base circle having a diameter n-times that of the rolling circle. The cycloid is generated from a point in the rolling circle which is spaced a distance from the centre of the rolling circle corresponding to the eccentricity.

The same cycloid can also be created in that a different pair of circles roll on one another; here too, one circle is referred to as a base circle or reference circle and the other circle is referred to as the rolling circle. In this case, however, the rolling circle encloses the base circle or reference circle (Dubbel, 13th edition, 1970, page 144, FIG. 138). Both methods of producing a trochoid are equivalent and can be transformed into one another.

From the time of the first embodiments of this kind of hydraulic machine, there have been attempts to improve the machine, for example, in respect of wear, efficiency, running noise and similar features. Here, efforts include matching the individual parameters to one another, and in some cases ratios are specified within which the individual parameters have to move (EP 0 079 156 B1).

Not all the demands made of such a machine, however, can be met by specifying relationships of parameters or by selecting parameter ranges.

It is admittedly known from DE 14 26 751 A1 to correct the radii of the rolling curves of the two displacement elements with the period of a tooth pitch with respect to a constant value, but this leads only to evening-out of the torque generated in motor operation and to a greater uniformity of the amount of fluid discharged in pump operation, without noticeable improvement in efficiency or noticeable reduction in wear.

The invention is therefore based on the problem of providing a hydraulic machine with which demands that could not previously be met are now satisfied in an improved manner.

This problem is solved in a hydraulic machine of the kind mentioned in the introduction in that of the parameters determining the function f, at least one parameter varies in the circumferential direction periodically with the period of a tooth pitch.

The parameters are therefore no longer constant in the circumferential direction. The tooth profile can now be matched over sections or in areas to the specific local requirements. For example, individual parts of the tooth profile can be better dimensioned in respect of a flank contact pressure whereas other regions can now be formed in such a way that they satisfy the sealing requirements. Previously, this was impossible or only possible to a very limited extent. Generally, a compromise had to be found which fulfils both requirements fairly well. This restriction ceases to apply by virtue of the variation of the parameters in the circumferential direction. Besides the improvement in tightness and consequently the increase in volumetric efficiency, wear can also be reduced and operating characteristics of the machine can be improved, for example, a more uniform torque when the machine is being used as a motor, or a more uniform pumping capacity when the machine is being used as a pump.

In a preferred embodiment, the eccentricity varies. This results in lower contact stresses and an improved engagement factor. With low numbers of teeth, the engagement factor ratio, that is, the preservation of the seal when shifting from one sealing point to another, is often a problem. Through a variation in the eccentricity, an improvement can be achieved here. Wear is reduced and the service life is consequently longer. The improved engagement ratios mean that the machine can be operated with or at a higher pressure. It has proved especially advantageous that a phase displacement of torque peaks in motor operation and of volume flow peaks in pump operation can be achieved by varying the eccentricity.

Here, it is preferable for the eccentricity to increase and decrease in each period by an amount A which lies in the range of less than or equal to 5% of its mean value. The variation in the eccentricity is therefore relatively small. Nevertheless, it enables the advantageous properties to be achieved.

It is also an advantage for a circumferential curve formed by the varying eccentricity to have the same length as the circumference of a circle of radius E. This produces favourable frictional values.

The circumferential curve is advantageously continuously differentiable. It is therefore kept free of discontinuities.

Advantageously, one displacement element is fixed and the other rotates and orbits relative thereto. With the variation in the eccentricity it is therefore advantageous for the machine to be constructed as an orbiting machine.

The variation in the eccentricity preferably follows a sine function. Such a variation is easily reproducible. Harmonic transitions and positive and negative deviations from the circular form of the circumferential curve are produced. The sine function can also be phase-shifted.

It is also preferred for the eccentricity to follow a circumferential curve with portions curved in towards the midpoint, the radius of curvature of these portions being greater than the product of the number of teeth and the eccentricity. The radius is, as it were, negative. Here, the travelling speed of the contact point between the rolling circles of gearwheel and annular gear can be varied without risk of this point changing the direction of movement over sections. The circumferential curve can also be formed by straight line sections.

It is also preferred for the generating circle radius to vary periodically. In particular when the radii of the rolling circles are varied simultaneously, this produces a better engagement ratio of gearwheel and annular gear with lower contact stress, which allows a higher pressure combined with longer service life, creates a more uniform operation and leads to improved efficiency.

It is especially preferred for the reference circle radius to vary as a function of the generating circle radius. In that case, the radii can also change abruptly, so that the sections of the particular teeth can be specifically dimensioned with a view to their function.

In that case, the generating circle radius and the reference circle radius are preferably constant over sections and form tooth sections, and adjacent tooth sections have a common tangent at the contact point. Outwardly it is not therefore visible at one side that a change in the generating circle radius or in the reference circle radius has taken place. The tooth surface continues to remain "smooth". A transition from one generating circle radius to another also produces a gentle transition which does not adversely affect the running behaviour of the machine. On the contrary, the running behaviour is beneficially influenced, because each tooth section can be constructed with a view to its function.

In a preferred embodiment, the radii of rolling circles for gearwheel and annular gear additionally vary periodically as a function of the number of teeth, the annular gear having over its circumference one more period than the gearwheel. Such a machine has an improved internal seal. One period therefore corresponds to one tooth pitch, wherein within one tooth pitch there can be in turn separate function periods.

Preferably, the teeth are arranged in each case immovably in their respective displacement elements. The teeth are therefore not constructed as rollers or cylinders. On the contrary, they are fixed.

The invention is described hereinafter with reference to preferred embodiments in conjunction with the drawings, in which FIG. 1 shows a diagrammatic cross-section through a machine, FIG. 2 is a sketch explaining different variables, FIG. 3 shows a variation of the eccentricity in a machine, FIG. 4 is an enlarged fragmentary view from FIG. 3

Figure 1:
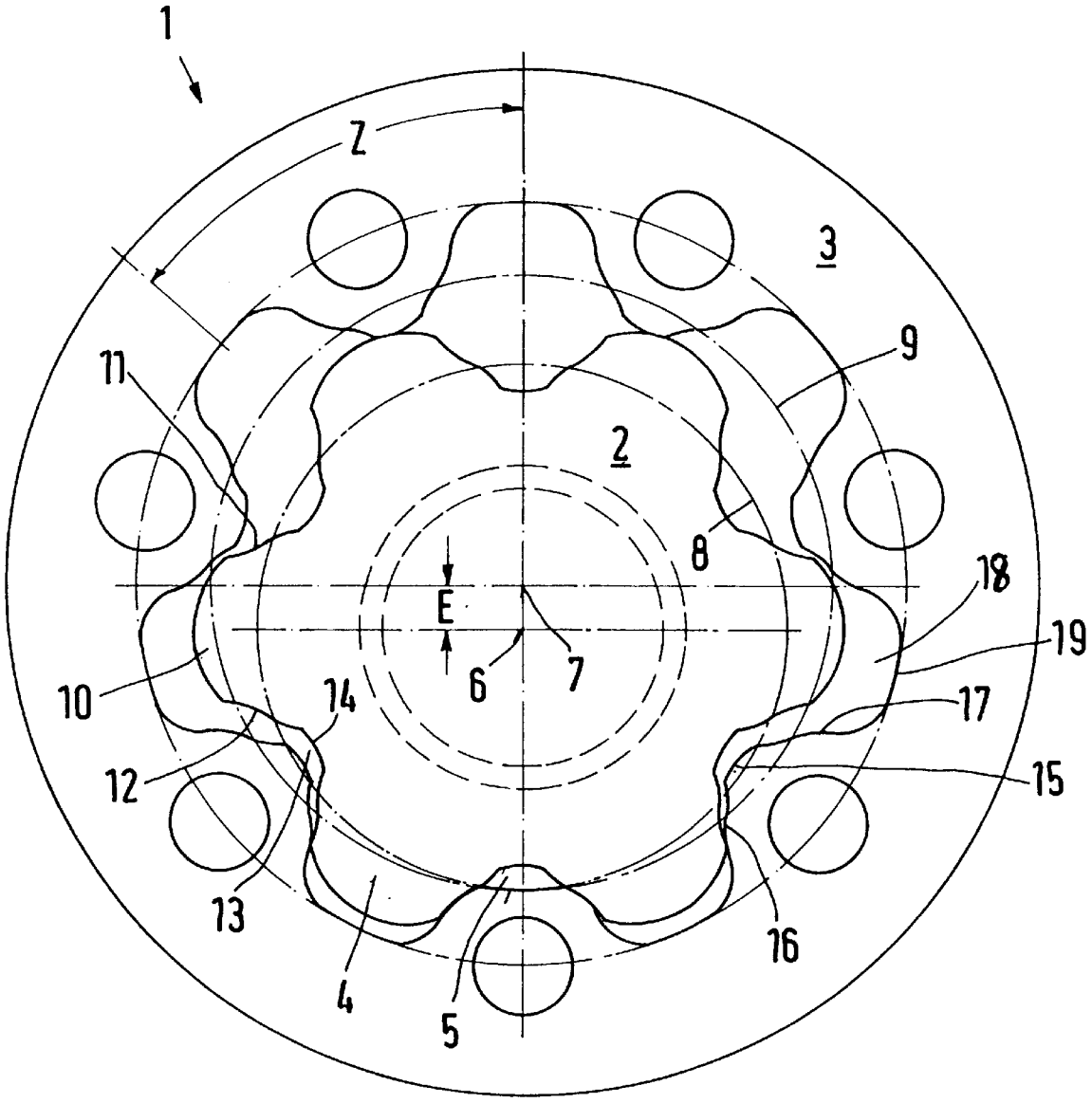

A hydraulic machine 1 has a gearwheel 2 and an annular gear 3. The gearwheel 2 has N external teeth 4, in this particular case six external teeth 4. The annular gear 3 has N+1 internal teeth 5, in this particular case, seven. The number of internal teeth 5 is therefore always one more than the number of external teeth 4. The gearwheel has a midpoint 6. The annular gear 3 has a midpoint 7. Both midpoints 6, 7 are offset with respect to one another by an eccentricity E. In operation, the gearwheel 2 rotates about its midpoint, whereas it orbits around the midpoint of the annular gear 3. When the annular gear 3 is likewise rotatably mounted, both parts may also rotate, the midpoints 6, 7 remaining in their respective positions.

The movement of gearwheel 2 and annular gear 3 can be represented by a rolling circle 8 for the gearwheel 2 and a rolling circle 9 for the annular gear 3. Here, the rolling circle 8 rolls anticlockwise in the rolling circle 9, the rolling circle 8 itself rotating in a clockwise direction.

Each external tooth 4 has a tooth tip 10 and tooth flanks 11, 12. Adjacent external teeth 4 are separated by tooth spaces 13, with a bottom land 14. The same applies to the internal teeth 5. Each internal tooth 5 has a tooth tip 15 and two tooth flanks 16, 17. Adjacent internal teeth 5 are separated from one another by a tooth space 18 with a tooth bottom land 19.

The tooth tips 10 of the external teeth 4 are formed by a trochoid-type curve, for which individual variables are to be explained with reference to FIG. 2. The rolling circle 8 of the gearwheel 2 and the rolling circle 9 of the annular gear 3 touch each other at a point P. The rolling circle 8 has a radius RH. The rolling circle 9 has a radius RK. The point P is always located on a straight line 40 which connects the midpoints 6 and 7. The radius RC of a reference circle or base circle 21 is marked off this straight line 40 starting from the midpoint 7 on the side remote from the midpoint 6. The point 39 thus found is the midpoint of a generating circle or circle system 20. A straight line S between the midpoint of the generating circle 20 and the point P intersects (and this also applies to all other positions of the generating circle 20) the curve of the circle at a point A which is a point of the tooth contour. The rolling circle 8 is now kept fixed and the rolling circle 9 is rolled on it. The midpoint 7 orbits around the midpoint 6. The point P travels clockwise on the rolling circle 8. During rolling, a radial ray 41 also travels about the midpoint 6, namely at a speed reduced by the factor N (=tooth number of gearwheel), that is to say, the angle between a connecting straight line from the point P to the midpoint 6 and the straight line 40 is zero. In the state illustrated in FIG. 2, both straight lines coincide with one another. The relation between an angle $\alpha$ between point P (or line 40) and the ordinate axis Y, that is the angle a being the angle over which the eccentricity has turned, and the angle VK ($VK=\alpha/N+1$) which is the angle that the annular gear ring has rotated around its own centre. The angle $\alpha$ is continuously measured, that it to say, it increases on each full rotation of the point P through 360°. In this particular case, it is just 360°. The distance RC is marked off on the radial line 41, starting from the midpoint 6, giving a point 43. This now gives three points of a parallelogram, namely the midpoints 6 and 7 and the point 43. The fourth point 39' is the midpoint of the generating circle 20.

In the construction of such a tooth structure, the illustrated variables need not be kept constant in the circumferential direction. A variation in the variables enables technically useful and advantageous effects to be achieved. The external teeth 4 and the internal teeth 5 can assume completely new forms. For example, tooth tips 10, 15 can be formed substantially independently of the tooth flanks 11, 12 and 16, 17 so that the tooth tips 10, 15 can be constructed with regard to an improved seal, while the tooth flanks 11, 12, and 16, 17 can be constructed with regard to an improved flank contact pressure. On the one hand this means that the machine can be loaded with a higher pressure, that is to say, as a pump it can produce a higher pressure and as a motor it can be subjected to a higher pressure. Despite that, wear can be kept to a minimum. Length of service life is increased.

Figure 3:
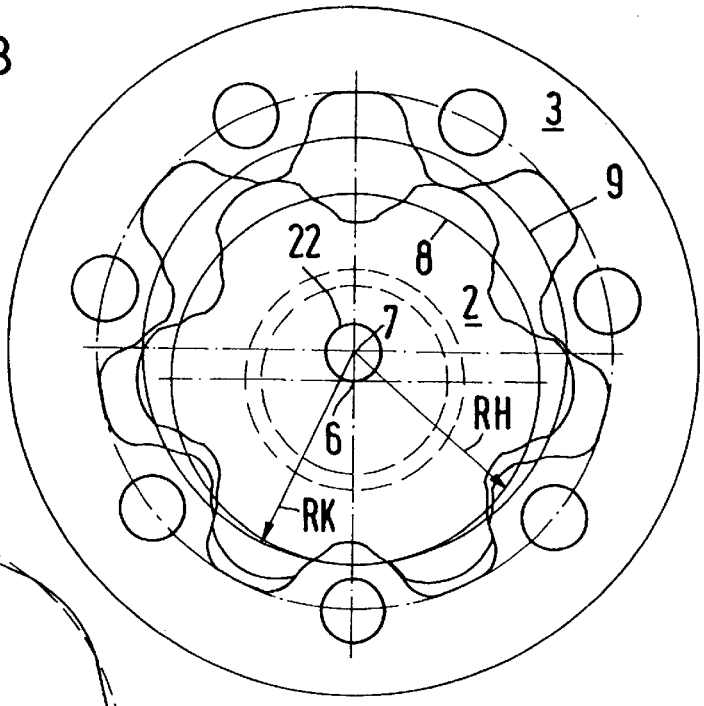
Figure 4:
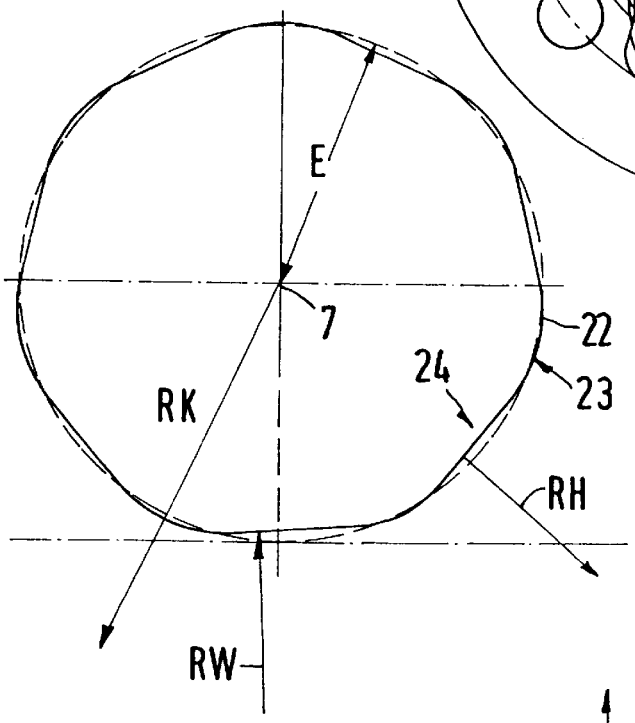
Figure 5:
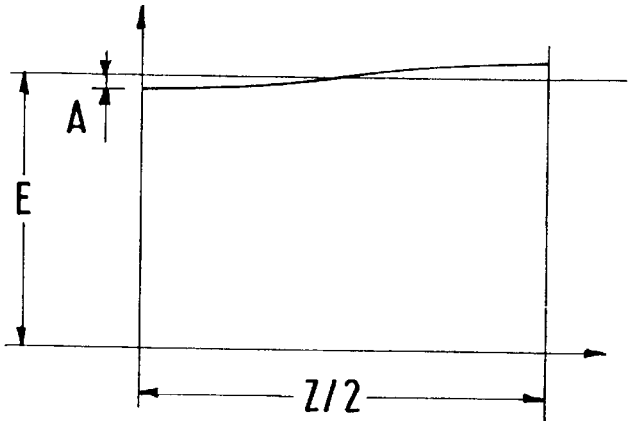
FIG. 5 is a representation of the change in the eccentricity.

A first example of such a variation is illustrated in FIGS. 3 to 5. The midpoint 6 of the rolling circle 8 of the gearwheel 2 no longer moves on a circle of radius E about the midpoint 7 of the rolling circle 9 of the annular gear 3, but on a circumferential curve 22 which is produced when the function illustrated in FIG. 5 for a half tooth pitch Z/2 is superimposed on the circle of radius E. This function is a periodically recurring function, for example, of the sinusoidal type having an amplitude A. This amplitude is shown on an exaggeratedly large scale in FIG. 5. In reality this amplitude A has a value in the range of at most equal to 5% of the eccentricity E. It produces the circumferential curve 22 of the midpoint 6 of the rolling circle 8 around the midpoint 7 of the rolling circle 9, illustrated in FIG. 4. This circumferential curve 22 has outwardly curved portions 23 and inwardly curved portions 24, the inwardly curved portions having a radius of curvature RW which is larger than N times the eccentricity. The inwardly curved portions 24 approximate to the form of a straight line. The length of the circumferential curve 22 is the same as the length of a curve of a circle, that is, the circumferential length, of a circle of radius E. The circumferential curve 22 has no discontinuities.

Figure 6:
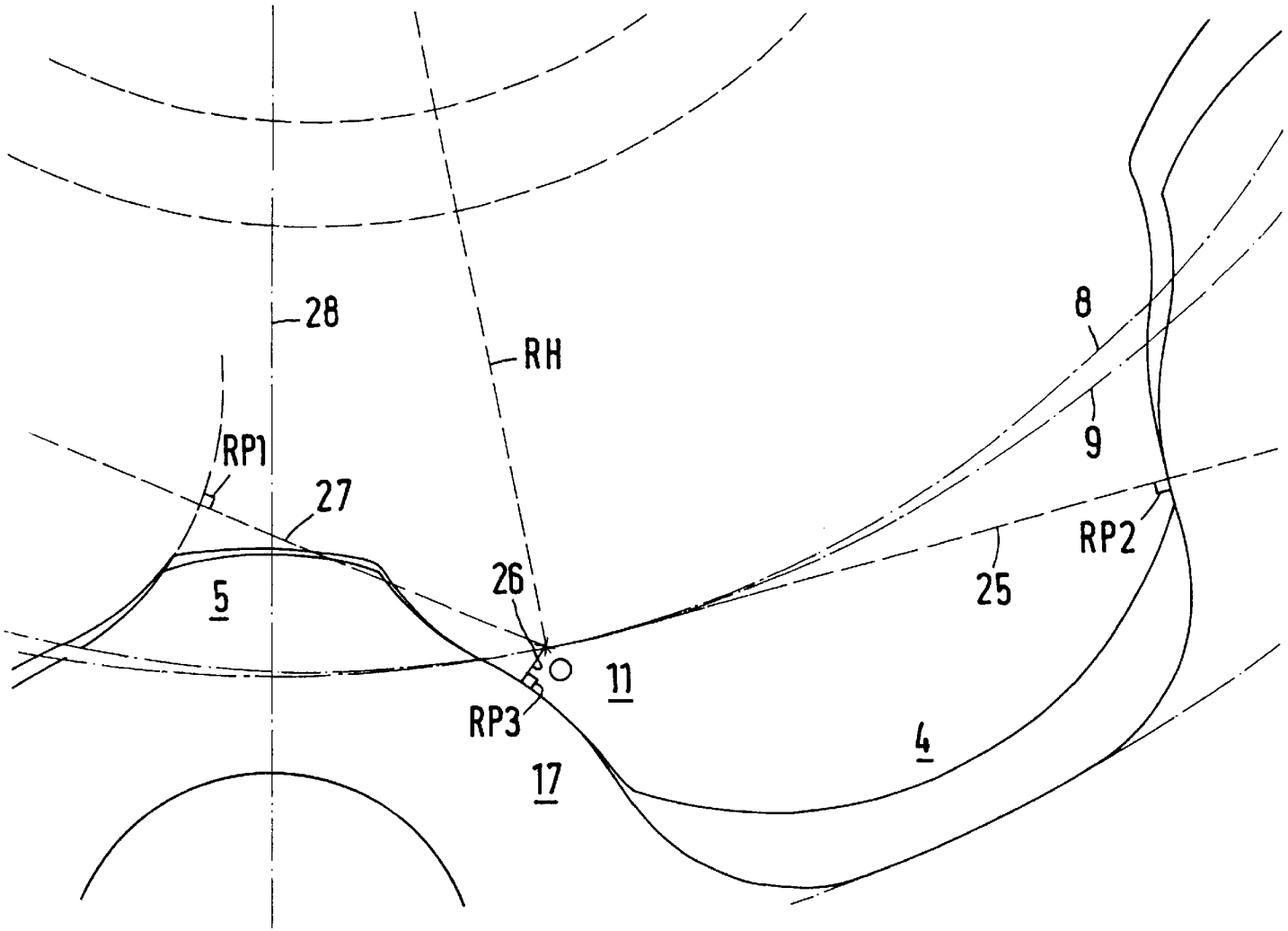
FIGS. 6 and 7 are representations explaining advantages of a machine illustrated in FIG. 3.
Figure 7:
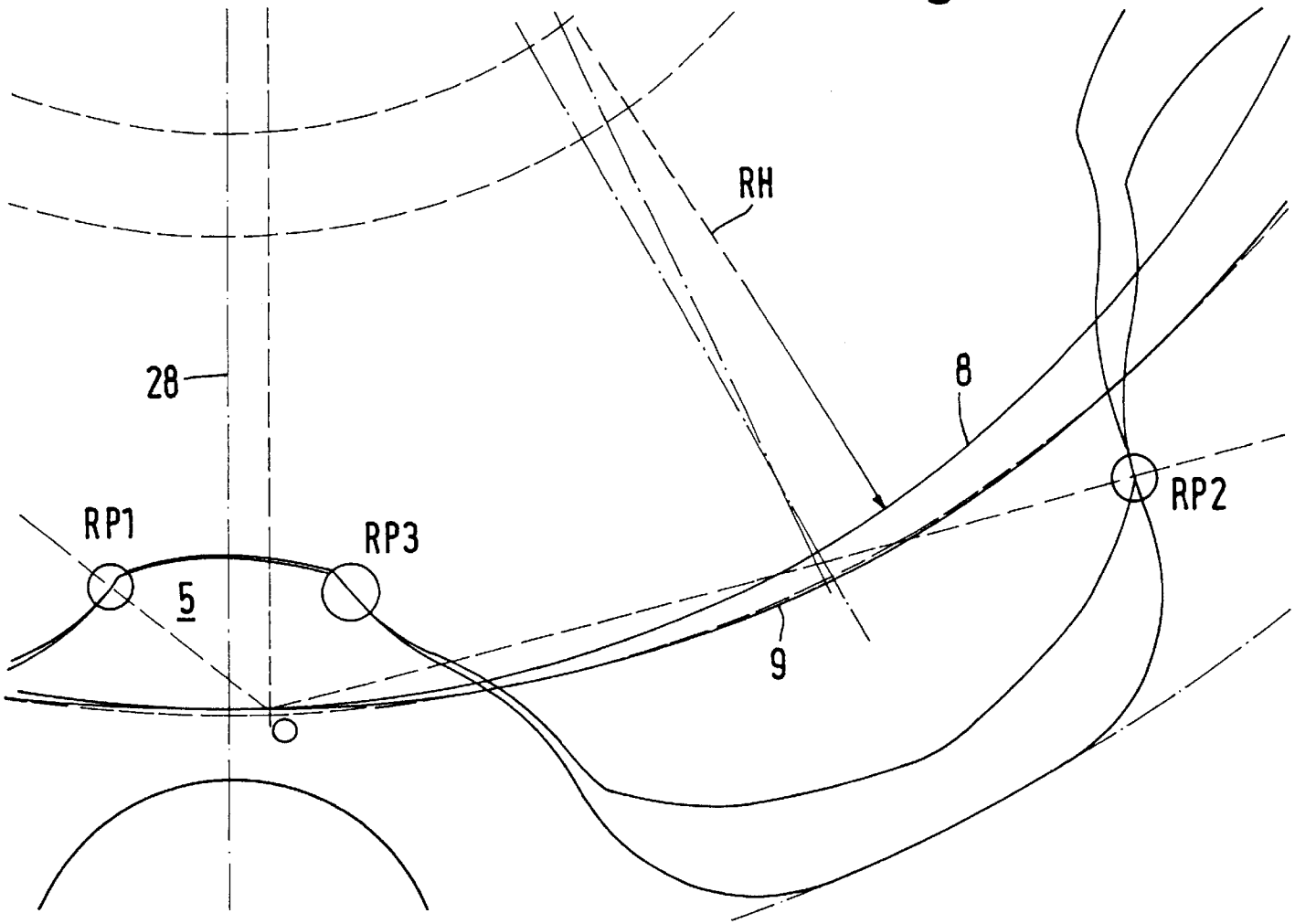

The effect that is achieved with such a variation in the eccentricity E is illustrated in FIGS. 6 and 7, FIG. 6 illustrating a conventional machine in which the eccentricity E is held constant in the circumferential direction.

In the known case, engagement, that is, the contact between external tooth 4 and internal tooth 5 at the flanks 11 and 17 respectively, is effected at a point RP3 corresponding to the instantaneous rolling point O of the two rolling circles 8, 9. Normals 25, 26, 27 which have been set up at existing points RP3 and RP2 and at a desired contact point RP1, respectively, intersect at this rolling point O. It is clear that the contact point RP1 is to the left only of a theoretical contact point, whereas the contact point RP2 on the right-hand side is real and can be formed.

On the other hand referring to FIG. 7, if the eccentricity is varied periodically in the circumferential direction, the rolling point O between the rolling circles 8, 9 can be advanced very much closer to a centre line 28 of the internal tooth 5 on the same movement of the gearwheel 2 with respect to the annular gear 3. One sees that all contact points RP1, RP2 and RP3 can be construed in the desired direction. Variation of the eccentricity enables overlapping of the contact points RP1 and RP2 to be achieved, which was not possible with the known construction.

Figure 8:
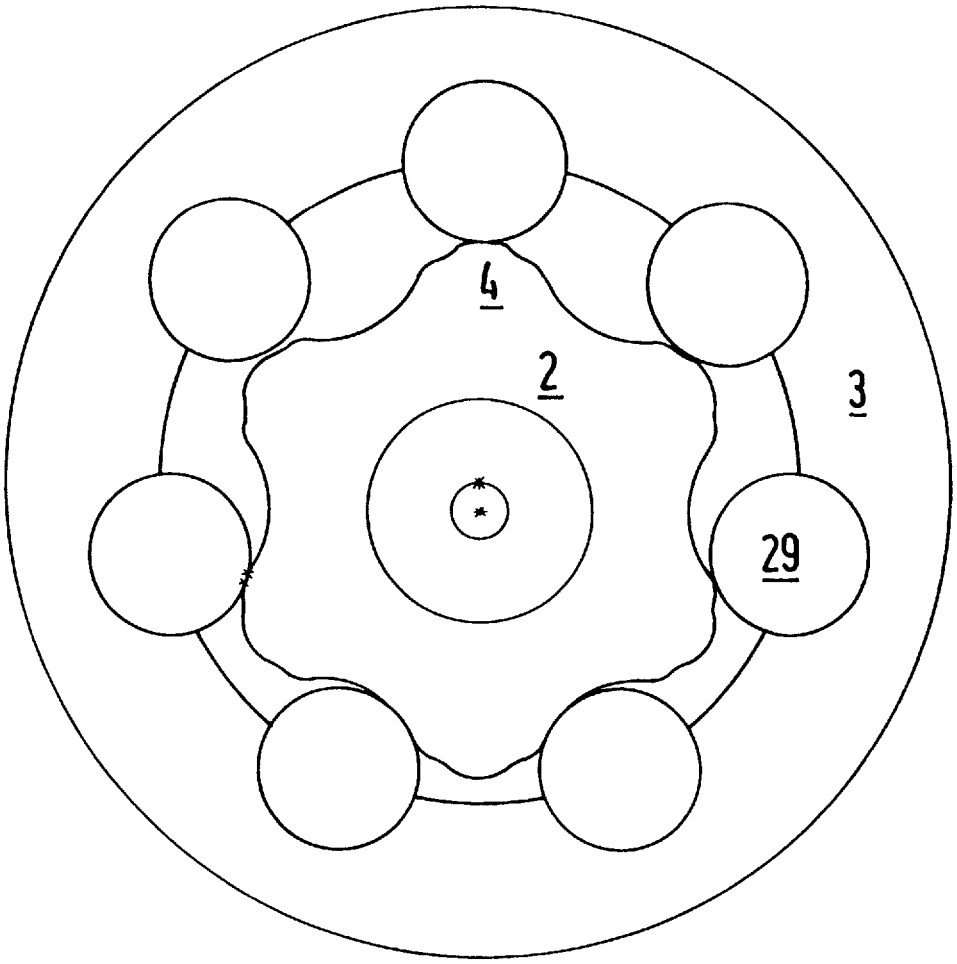
FIG. 8 is a diagrammatic illustration of a machine with a variation in function dependent on the number of teeth.

FIG. 8 shows a hydraulic machine in which the internal teeth in the annular gear 3 are formed by rollers 29. The external teeth are formed in that the parameter N is additionally varied in the construction explained in conjunction with FIG. 2. The number of teeth in such a machine is fixed, of course. It must be a natural number. A variation can still be implemented, however, if one bears in mind that the number of teeth N is one of the two factors for determining the radii of the rolling circles 8, 9 of gear wheel 2 and annular gear 3. The following applies, in fact:

$$RK=E\times(N+1)$$

$$RH=E\times N$$

If N now has superimposed on it a wave function which has N-periods for the rolling circle 8 of the gearwheel 2 and N+1 periods for the rolling circle 9 of the annular gear 3, a tooth form of the external teeth 4 as illustrated in FIG. 8 is obtained. Such a machine allows a very close engagement of gearwheel 2 and annular gear 3, with the result that a high volumetric efficiency combined with low friction can be achieved. The variation of the remaining variables was here kept very small for the sake of clarity.

Figure 9:
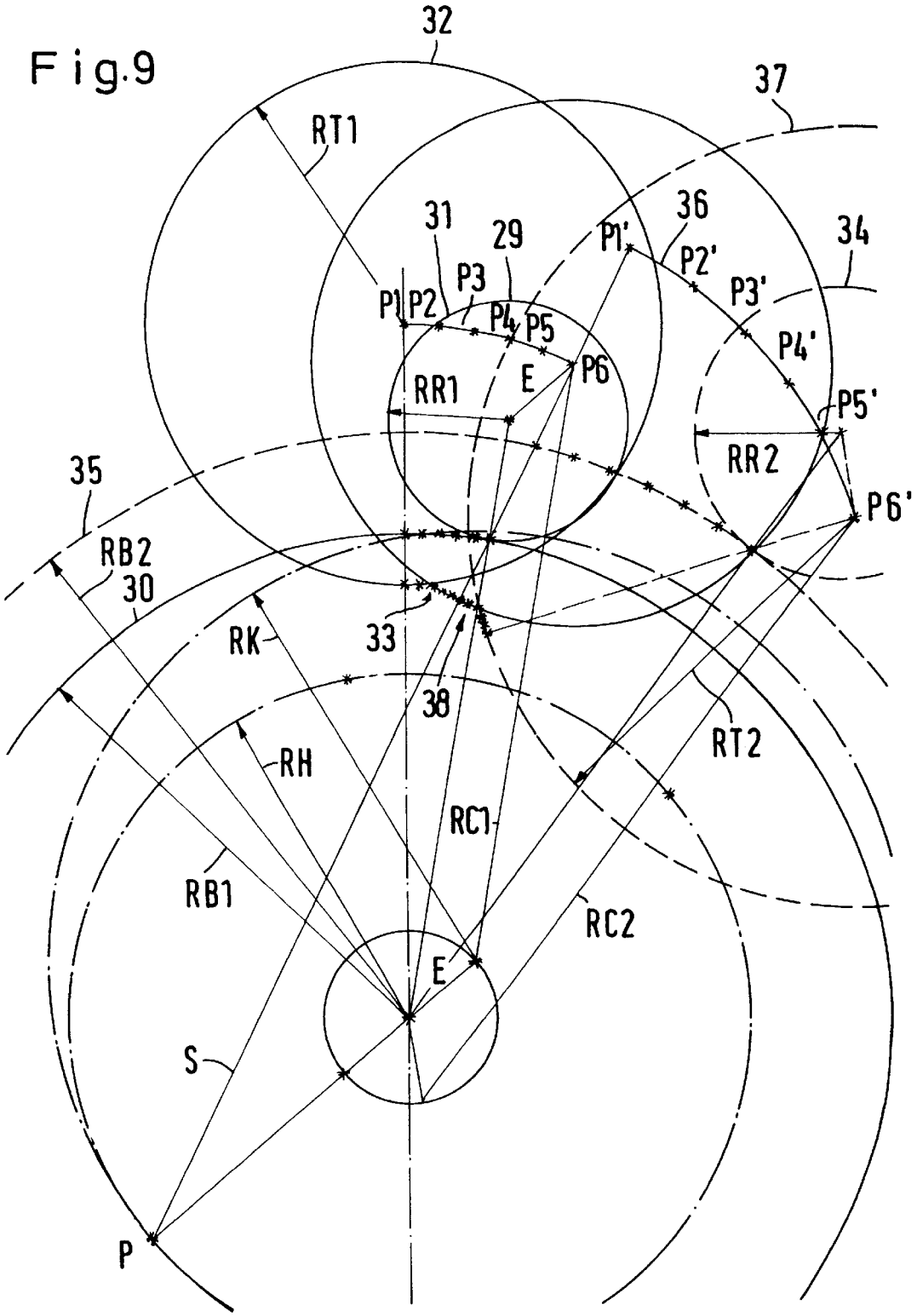
FIG. 9 is a diagrammatic illustration explaining the change from one generating circle radius to another.

FIG. 9 shows the possibility of varying the reference circle radius RC jointly with the generating circle radius RT.

Figure 2:
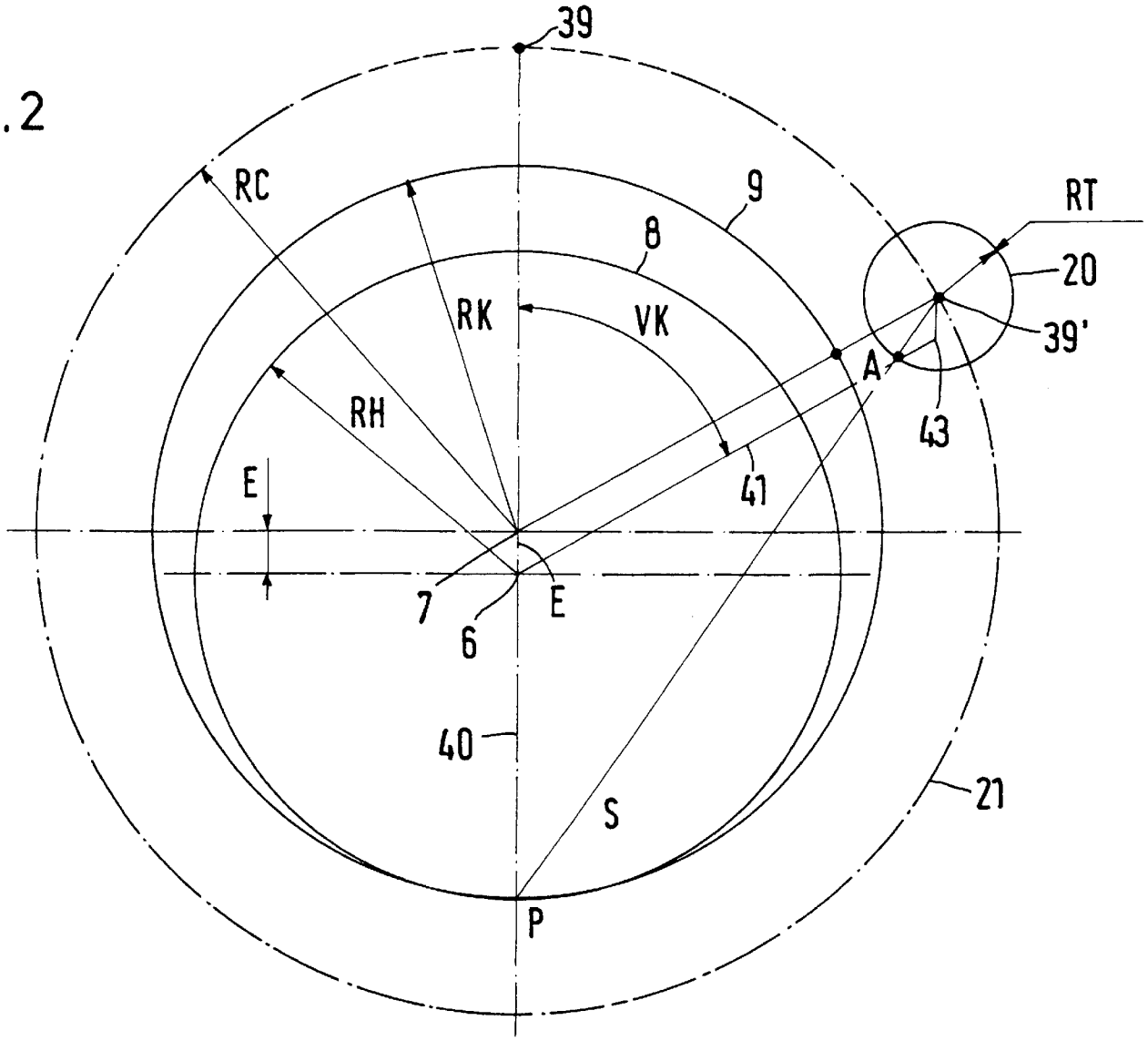

A first rolling circle 29 of radius RR1 which rolls on a first base circle 30 of radius RB1, generates a first curve 31 with the points P1 to P6 (corresponds to point 39 in FIG. 2). These points P1 to P6 are midpoints of generating circles 32 of radius RT1. These generating circles 32 (which correspond to the circle 20 of FIG. 2) form a first portion 33 of the tooth profile. The radius RC of the above-mentioned reference circle 21 is larger by the factor (N+1)/N than the base circle 30.

A second rolling circle 34 of radius RR2, which can differ from the radius of the rolling circle RR1, rolls on a second base circle 35, and defines a second curve 36 with points P1' to P6'. These points on the curve 36 are midpoints of generating circles 37, which have a radius RT2. This radius is larger than the radius RT1 of the first generating circles 32. With the enlargement of this radius RT2, the enlargement of the radius RB2 of the base circle 35 is compensated, so that at the tooth tip there is a smooth transition between the region 33, which has been formed by means of the first generating circles 32, and a region 38, which has been formed by the second generating circles 37. At the contact point between the two portions 33 and 38, both portions 33, 38 have the same tangents.

A machine with a gearwheel 2 constructed in this manner can best be used when the internal teeth 5 of the annular gear 3 are not formed by rollers but can be suitably matched to the form of the external teeth 4.

If the variation in the number of teeth is undertaken together with the variation in the reference circle radius RC and the generating circle radius RT, machines of the orbiting type and the gerotor type can be produced, which have excellent engagement factors with low contact stresses. Machines which can be loaded with higher pressure and at the same time have a relatively long service life are obtained. In many cases, a more uniform operation can also be achieved. Efficiency is improved.

We claim:

1. A hydraulic machine with two displacement elements rotatably movable relative to one another, said elements comprising a gearwheel having a plurality of teeth and an annular gear having a plurality of teeth, the number of teeth of the annular gear being one more than the number of teeth of the gearwheel, in which machine the form of the teeth of at least one displacement element being defined at least over sections by a trochoid-type curve T=f (RC, E, RT) as the function of parameters comprising a reference circle radius RC, an eccentricity E and a generating circle radius RT, and in which at least one of the parameters varies in a circumferential direction periodically with the period of a pitch of a tooth.

2. A machine according to claim 1, in which the eccentricity varies.

3. A machine according to claim 1, in which the eccentricity increases and decreases in each period by an amount which lies in a range from 1 to 5% of a mean value of the eccentricity.

4. A machine according to claim 2, in which a circumferential curve formed by the varying eccentricity has a same length as a circumference of a circle of radius E.

5. A machine according to claim 4, in which the circumferential curve formed by the varying eccentricity is continuously differentiable.

6. A machine according to claim 1, in which one displacement element is fixed and the other displacement element rotates and orbits relative thereto.

7. A machine according to claim 1, in which the eccentricity varies following a sine function.

8. A machine according to claim 1, in which the eccentricity follows a circumferential curve with portions curved in towards a midpoint, a radius of curvature of the portions being greater than a product of the number of teeth and the eccentricity.

9. A machine according to claim 1, in which the radii of the rolling circles for the gearwheel and annular gear vary periodically as a function of the number of teeth, the annular gear having over its circumference one more period than the gearwheel.

10. A machine according to claim 1, in which the generating circle radius varies periodically.

11. A machine according to claim 10, in which the reference circle radius varies as a function of the generating circle radius.

12. A machine according to claim 11, in which the generating circle radius and the reference circle radius are constant over sections and form tooth sections, and adjacent tooth sections have a common tangent at a contact point of the sections.

13. A machine according to claim 10, in that the teeth are arranged immovably in their respective displacement elements.

* * * * *